US005690596A

United States Patent [19]

Parker

[11] Patent Number: 5,690,596

[45] Date of Patent: Nov. 25, 1997

[54] UPPER BODY EXERCISE APPARATUS

[76] Inventor: David G. Parker, 10 Meeting House Sq., Middleton, Mass. 10949

[21] Appl. No.: 616,701

[22] Filed: Mar. 15, 1996

[51] Int. Cl.[6] ..... A63B 21/02

[52] U.S. Cl. ..... 482/126; 482/122; 482/121

[58] Field of Search ..... 482/126, 121, 482/122, 49

[56] References Cited

U.S. PATENT DOCUMENTS

| | | | |
|---|---|---|---|
| 1,680,901 | 8/1928 | Meyer . | |
| 2,529,347 | 11/1950 | Mohler et al. . | |
| 2,806,699 | 9/1957 | Spooner . | |
| 3,861,677 | 1/1975 | Wheeldon . | |
| 4,023,796 | 5/1977 | Kusmer . | |
| 4,169,590 | 10/1979 | Johansen . | |
| 4,465,276 | 8/1984 | Cox | 482/126 |
| 4,629,186 | 12/1986 | Aldridge . | |
| 4,720,096 | 1/1988 | Rogers . | |
| 4,861,022 | 8/1989 | Boatcallie . | |
| 5,026,050 | 6/1991 | Leung et al. . | |
| 5,044,630 | 9/1991 | Ventimiglia . | |
| 5,246,413 | 9/1993 | Koblick . | |
| 5,267,929 | 12/1993 | Chen . | |
| 5,507,712 | 4/1996 | Chang | 482/126 |

FOREIGN PATENT DOCUMENTS

| | | |
|---|---|---|
| 791616 | 6/1935 | France . |

*Primary Examiner*—Lynne A. Reichard

*Attorney, Agent, or Firm*—Cesari and McKenna, LLP

[57] ABSTRACT

An upper body exercise apparatus which is effective for developing a variety of muscle groups of the upper body. In a preferred embodiment, the apparatus comprises two V-shaped members which are pivotally attached at a central joint. One end of each member forms a grip for a user's hand. The opposite ends of the members form heads to which a desired number of force-resisting elements, either of the same or different types, are removably secured.

26 Claims, 10 Drawing Sheets

UPPER BODY EXERCISE APPARATUS

BACKGROUND OF THE INVENTION

1. Field of the Invention

The present invention relates generally to the field of exercise equipment and, more specifically, to a manually operated apparatus' for exercising the upper body.

2. Discussion of the Related Art

Numerous devices exist for exercising various portions of the human body in a variety of ways. Such conventional devices span a wide range from simple free weights to elaborate machines such as those offered by Nautilus and Stairmaster. Most conventional devices include some arrangement of weights or force-resisting elements. By either repeatedly lifting a weight or applying an opposing force to a force-resisting element, a user performs work, thereby exercising specific groups of muscles.

Many, if not most, conventional exercise devices exhibit one or more disadvantages which unduly limits the utility of such devices. For example, many conventional devices are simply too large or expensive to even be considered for use other than in a health club or similar commercial setting. Thus, at times when it is inconvenient or impossible for a person to visit such a facility (the weather is bad, schedule conflicts, etc.), that person is usually forced to forego desired exercise.

Second, many conventional exercise devices which are suitable for home use are severely limited in terms of their adaptability for users of varying abilities. Many such devices include force-resisting elements which are suitable for men, but which are too strong for women or children to use. Further, such force-resisting elements are often attached to the device in a manner that renders it either impossible or extremely difficult and inconvenient to change the elements (i.e., in order to substitute different elements for a different user or to replace a damaged element).

Yet another disadvantage of many conventional exercise devices is a lack of adequate safety features. For example, conventional devices which rely on ordinary metal springs as the force-resisting elements present several risks of injury to a user. A user's hands, fingers, skin or hair may be caught in the springs, or a spring may break sending sharp pieces of metal flying in random directions. In addition, when the springs are stretched far apart, the resulting tension may be too great for the user to control, thus resulting in a dangerous snap-back.

Still another disadvantage of many conventional exercise devices is that they are constructed primarily of metal parts which are both heavy and subject to corrosion. The sheer weight of many such devices makes it impractical to move them except on an infrequent basis. Such lack of portability represents a significant disadvantage for professional exercise instructors or communities that wish to make exercise equipment available on a shared basis at multiple locations. It may also represent a significant inconvenience to an individual who simply wishes to store his or her exercise equipment when not in use.

SUMMARY OF THE INVENTION

In brief summary, the present invention provides an upper body exercise apparatus which is effective for developing a variety of muscle groups as well as improving overall physical fitness for men, women and children alike. Exercise with the apparatus tones and defines all of the major muscle groups of the upper body, especially all of the different areas of the chest. The apparatus is also effective for developing the shoulders, back, lats, neck, arms, hands, wrists and stomach.

In a preferred embodiment, the apparatus comprises two generally V-shaped members which are pivotally attached at a central joint. One end of each member forms a grip for a user's hand. The opposite ends of the members form heads to which a desired number of force-resisting elements, either of the same or different types (e.g., elastomer springs, dashpots, combiner spring/dashpots, gas springs, metal springs, etc.), are removably secured. To exercise, the user simply grasps the grips and works the V-shaped members with a repetitive motion which is similar to that of a pair of scissors. In so doing, the user's efforts are opposed by the force-resisting elements, thereby creating effective exercise.

Depending upon the type(s) of force-resisting elements selected, the user may receive effective exercise in either one or two directions. That is, the elements may be chosen such that the user must apply force in only one direction or (alternately) in two directions to work the apparatus. In either case, the user exercises at all times from the same basic position and is not required to change grips or the orientation of the apparatus.

Because both the number and type of force-resisting elements may be easily changed by the user, the apparatus is readily adaptable to persons of widely varying abilities. Further, a particular user may easily change the elements in accordance with an exercise program in which, for example, more difficult elements are gradually introduced as the user becomes stronger and better conditioned.

The V-shaped members are preferably constructed as mirror images of each other from an advanced polymer composite material which is lightweight and not susceptible to corrosion. Such construction provides a long service life and permits the easy replacement of a single member, as opposed to the entire apparatus, in the event of damage.

Preferably, the central joint of the apparatus is constructed in the form of a pair of overlapping disks, one such disk being formed integrally with an associated V-shaped member. Each disk presses against a bearing surface which is located on the opposite V-shaped member. A nut and bolt or other fastener is used to hold the joint together such that the members may freely rotate. This arrangement provides a very strong, highly reliable joint which effectively resists torsional stresses while preventing significant loads from acting upon the fastener, thereby enhancing the service lives of the fastener and apparatus.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF ILLUSTRATIVE EMBODIMENTS

Figure 1B:
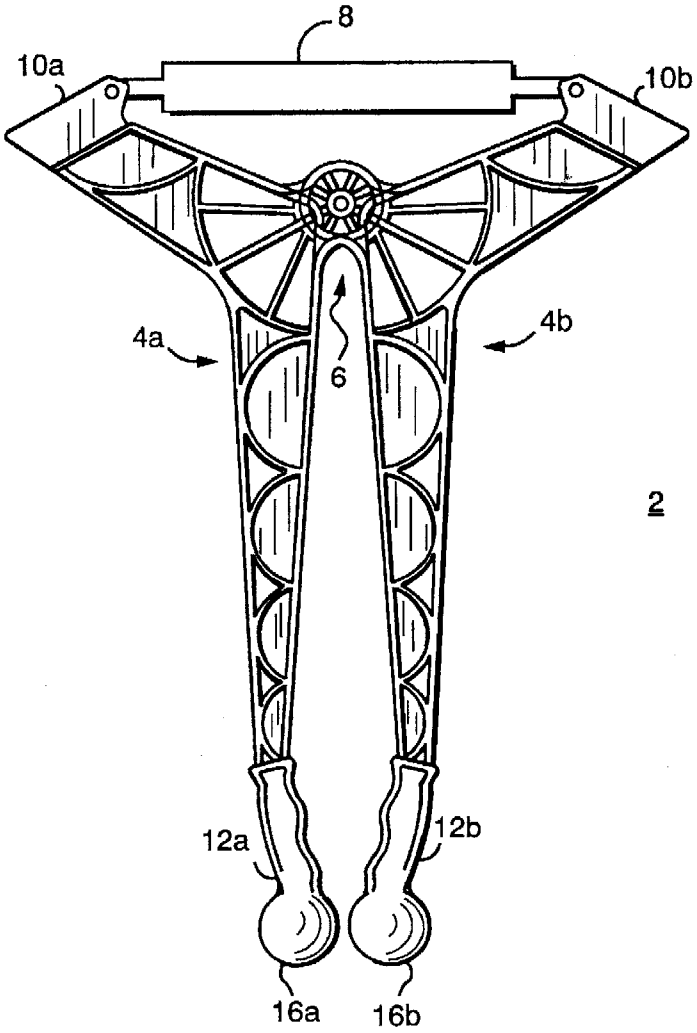
FIG. 1B shows the apparatus of FIG. 1A in a position which illustrates the range of motion of the apparatus when a user exercises with it.
Figure 1A:
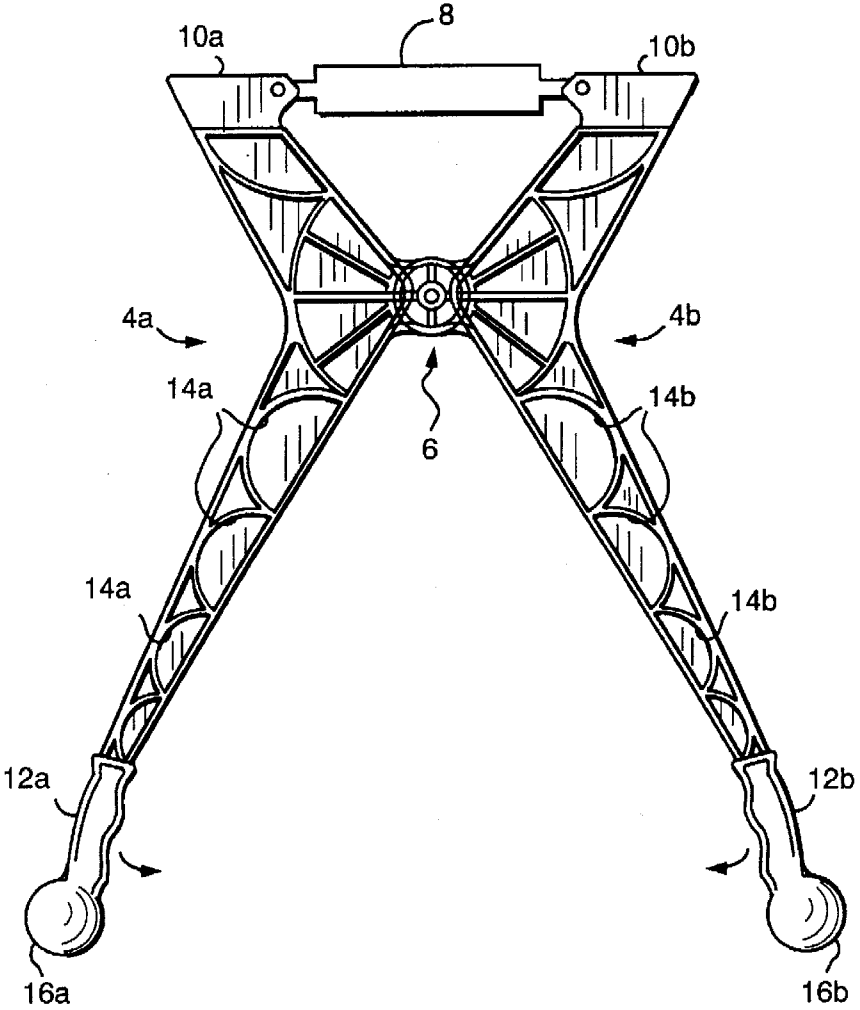
FIG. 1A is a front, elevational view of an upper body exercise apparatus constructed in accordance with a preferred embodiment of the present invention.

FIG. 1A shows a preferred embodiment of an upper body exercise apparatus 2 which comprises two generally V-shaped members 4*a* and 4*b* which are pivotally joined at their vertices by a central joint 6. One or more force-resisting elements 8 is connected between heads 10*a* and 10*b* located, respectively, at the upper ends of members 4*a* and 4*b*. Hand grips 12*a* and 12*b* are located, respectively, at the lower ends of members 4*a* and 4*b*. Hand grips 12*a* and 12*b* are formed with ball-shaped ends 16*a* and 16*b*, respectively. Members 4*a* and 4*b* each include a series of generally semicircular integral ribs 14*a* and 14*b* which provide increased strength and stiffness. Apparatus 2 is depicted in a resting or unstressed position in FIG. 1A. When a user (not shown) wishes to exercise, he or she grasps grips 12*a* and 12*b* and exerts forces in the directions of the arrows. Assuming the exerted force is sufficient to overcome the resisting force produced by element(s) 8, members 4*a* and 4*b* rotate in opposite directions about joint 6. The result is that grips 12*a* and 12*b* move together, while heads 10*a* and 10*b* move apart, thereby extending element 8, all as depicted in FIG. 1B. Subsequently, as the user reduces the exerted force, the force created by element 8 may act, depending upon the type(s) of elements selected, to restore apparatus 2 to its resting position. Typically, the user repeats the described motions many times to achieve muscular development and conditioning. By varying the orientation of apparatus 2 (i.e., the user may hold the apparatus in front with heads 10*a* and 10*b* oriented upward or downward, or the user may hold the apparatus behind him or her with the the heads oriented upward or downward, etc.), the user may effectively exercise different muscle groups as desired.

Members 4*a* and 4*b* are preferably constructed as mirror images of each other, which provides substantial savings in manufacturing cost, from an advanced polymer composite material. The polymer composite is preferably a short chopped fiber-reinforced resin that may be injection molded. Such composite material is strong, lightweight and immune to corrosion. By use of such material, the entire apparatus 2 weighs only a few pounds and is therefore highly portable. In addition, in the event of failure or damage to only one member, a user need only replace the affected member as opposed to the entire apparatus 2.

Figure 2A:
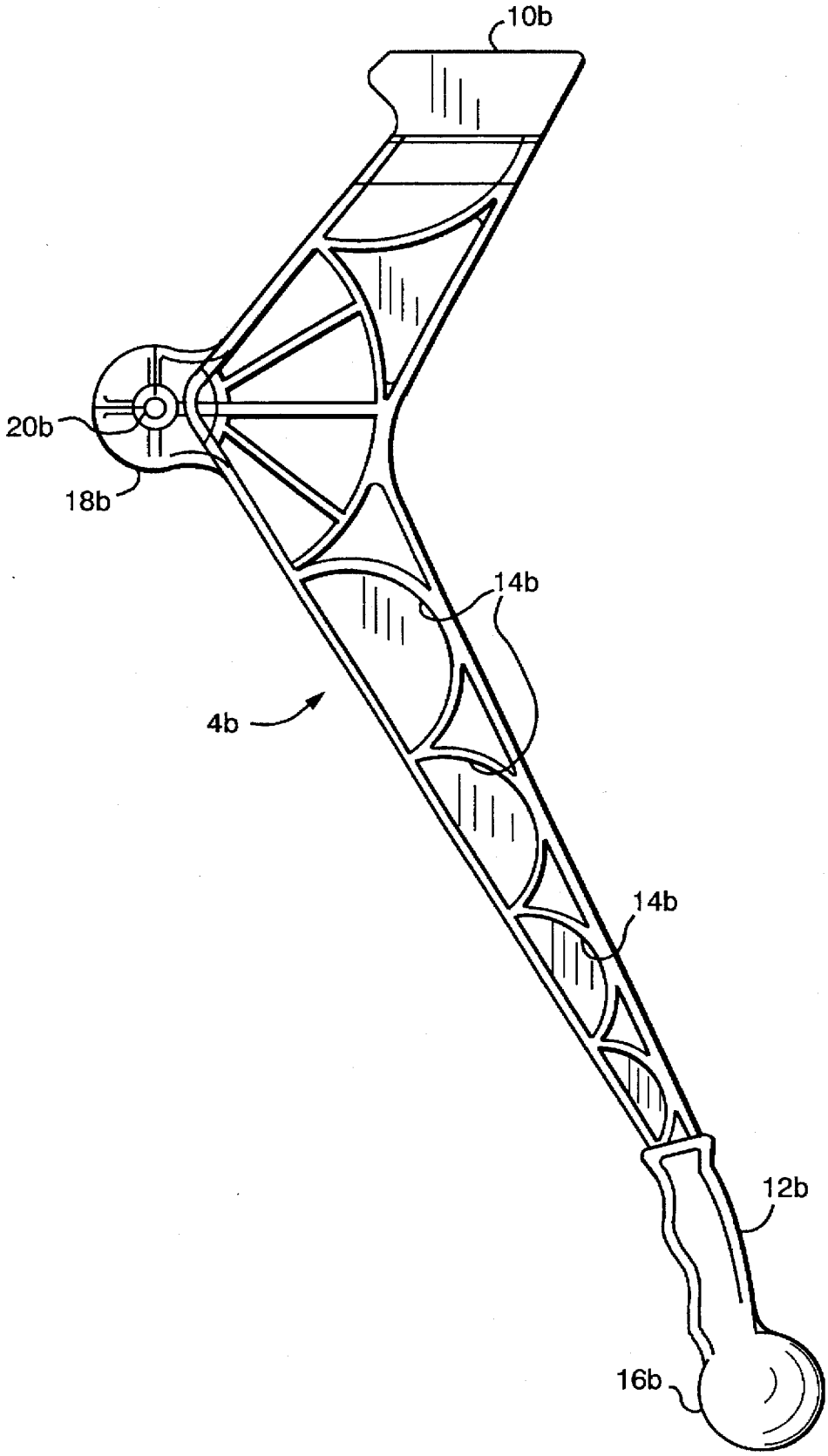
FIG. 2A is a front, elevational view of one of the V-shaped members of the apparatus shown in FIGS. 1A and 1B.
Figure 2B:
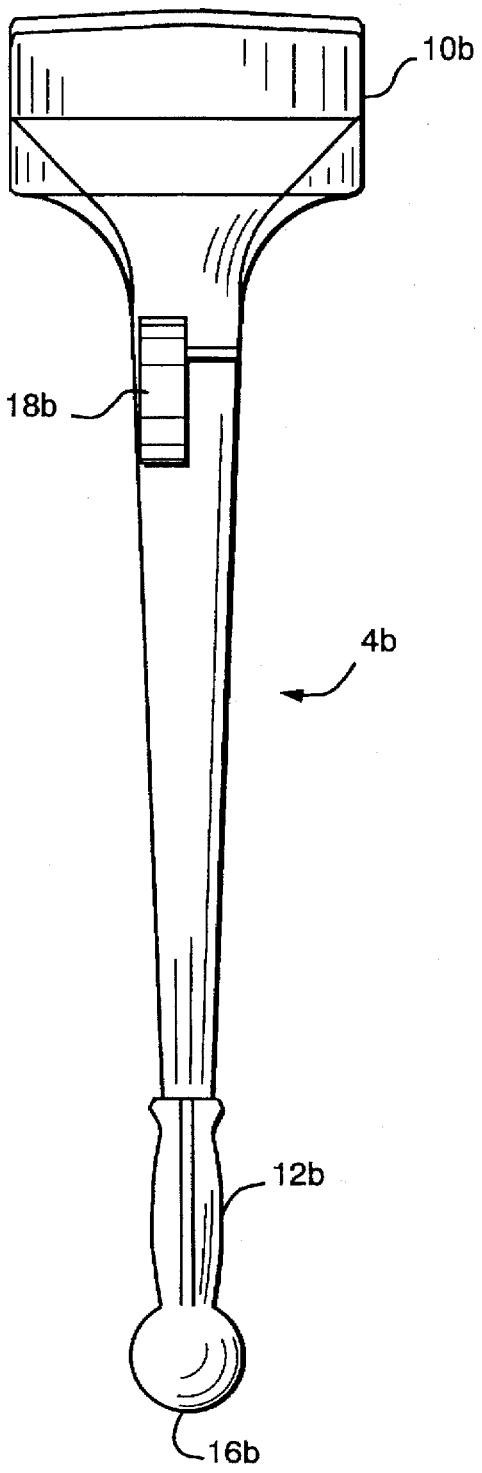
FIG. 2B is a left side, elevational view of the member shown in FIG. 2A.
Figure 3:
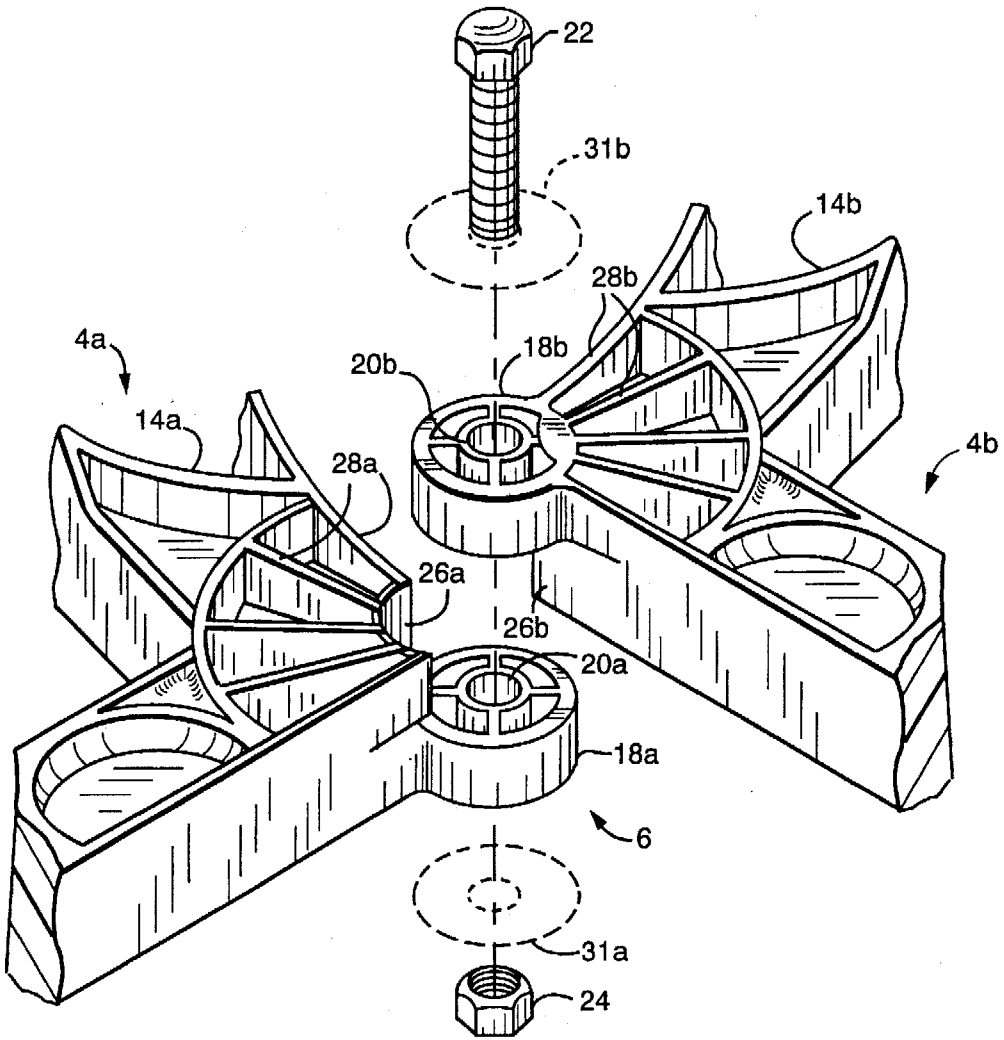
FIG. 3 is an enlarged, exploded view of the central joint of the apparatus shown in FIGS. 1A and 1B.

FIGS. 2A and 2B show member 4*b* (in front and side elevations, respectively) separated from apparatus 2 for greater clarity. A disk 18*b* having a central aperture (through hole) 20*b* is disposed at the vertex of member 4*b*.

disk 18*b* preferably has a thickness which is approximately one-half the thickness of member 4*b* at its vertex. As a result, as may be seen best in FIG. 3, when members 4*a* and 4*b* are assembled, dish 18*a* and 18*b* are overlapped and their respective apertures 20*a* and 20*b* are aligned. Any of a variety of fasteners, such as a combination of bolt 22 and nut 24, may be used hold central joint 6 together so long as it does not interfere with the free rotation of members 4*a* and 4*b*. Optional washers 31*a* and 31*b*, shown in phantom, may also be used. Such washers tend to prevent bolt 22 and nut 24 from wearing against disks 18*a* and 18*b* and also provide desirable surfaces for placement of a product name or logo.

When members 4*a* and 4*b* are assembled, disk 18*b* abuts a semicircular bearing surface 21*a* which is preferably formed as an integral part of member 4*a*. Likewise, disk 18*a* abuts bearing surface 26*b* which is formed as part of member 4*b*. Bearing surfaces 26*a* and 26*b* are preferably strengthened and stiffened by pluralities of integral ribs 28*a* and 28*b*. There are several advantages which are achieved as a result of this arrangement. First, when a user exercises and causes members 4*a* and 4*b* to repetitively rotate in opposite directions as described above, little stress is placed on the joint's fastener (bolt and nut). Indeed, most of the stress is dissipated in the form of thermal energy generated by disks 18*a* and 18*b* working against their respective bearing surfaces 26*b* and 26*a*. As a result, wear on the joint's fastener is minimized and its service life is greatly extended. Second, the closeness of the fit between the disks and their bearing surfaces permits very little "play" between members 4*a* and 4*b*. That is, central joint 6 tends to keep members 4*a* and 4*b* in a common plane and resist torsional or racking forces. Third, by using a preferred material such as the polymer composite recited above, disks 18*a* and 18*b* and bearing surfaces 26*a* and 26*b* are inherently sufficiently slippery that joint 6 will operate smoothly without lubrication.

Optionally, if additional force-resistance is desired beyond that provided by elements 8, a structure which provides frictional damping may be incorporated within central joint 6.

Figure 4A:
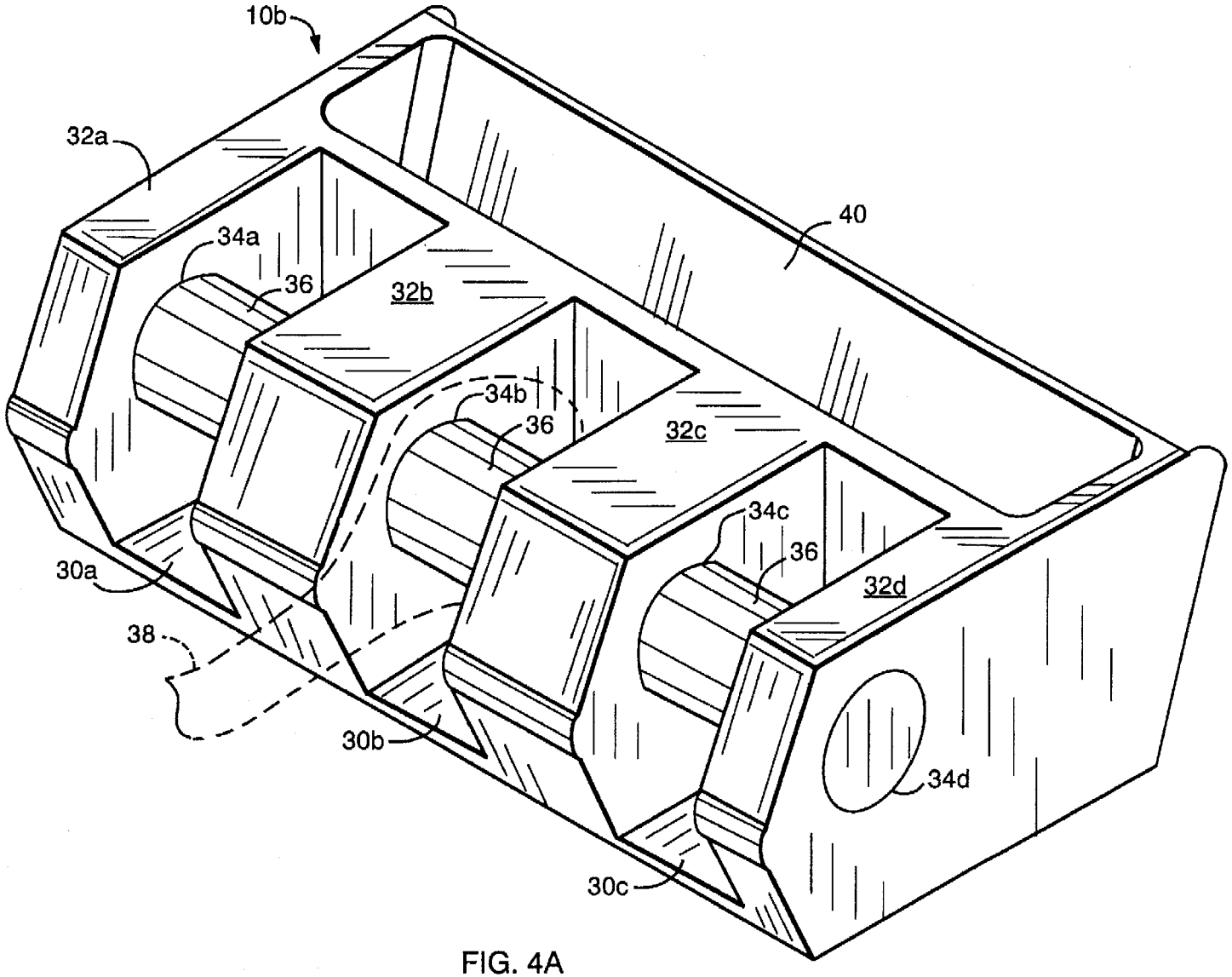
FIG. 4A is a perspective view of a first preferred embodiment of the heads of the apparatus shown in FIGS. 1A and 1B.
Figure 4B:
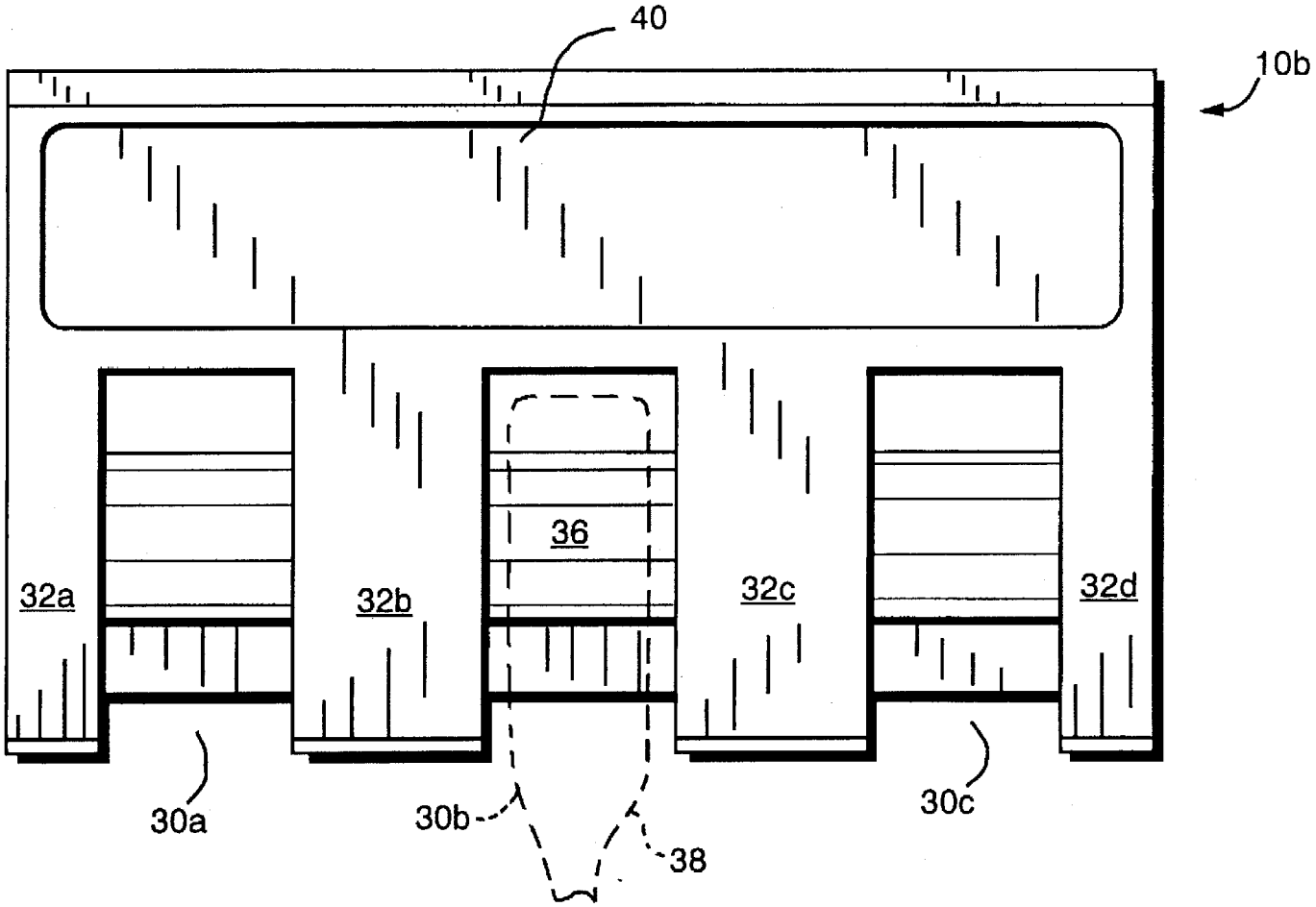
FIG. 4B is a top, plan view of the head of FIG. 4A.

FIGS. 4A and 4B show a first preferred embodiment for head 10*b* (FIG. 1A), it being understood that head 10*a* is preferably of substantially the same construction. In this embodiment, three vertical channels or slob 30*a*–30*c* are defined by a series of walls 32*a*–32*d* in which horizontal through-holes 34*a*–34*d* are respectively disposed. Trough-shaped area 40 is preferably hollowed out to reduce the weight of head 10*b*.

Desired force-resisting elements, an exemplary one of which is shown in phantom and designated by reference number 38, are placed into one or more of slots 30*a*–30*c*. Force-resisting elements 38, which may consist of elastomer springs, dashpots, combined spring/dashpots, gas springs, metal springs or other devices, are preferably constructed such that their ends have apertures which align with apertures 34*a*–34*d*. In this fashion, force-resisting elements 38 may be quickly and easily secured to head 10*b* by inserting a removable rod 36 (preferably stainless steel laterally through such elements apertures and apertures 34*a*–34*d*.

By varying the types of force-resisting elements, a particular user may obtain a configuration which is optimal for his or her ability and conditioning goals. For example, a user may choose to use two elastomer springs and one dashpot or damper-type element as the force-resisting elements. In that configuration, the elastomer springs will exert a force which the user must overcome to force hand grips 12*a* and 12*b* together (FIG. 1B). The dashpot, however, functions as an anti-backlash safety mechanism with respect to the elastomer springs. That is, when the elastomer springs are extended by application of force by the user, the dashpot will prevent heads 10*a* and 10*b* from rapidly snapping together in the event the user loses his or her grip or becomes fatigued.

It should be understood, of course, that a user may also vary the number and magnitudes of force-resisting elements from one to three (or more, if additional slots are provided) in order to increase or decrease the degree of difficulty (i.e., the mount of force necessary to overcome the force-resisting elements) of exercise. Thus, as a particular user exercises over a period of time and becomes stronger and better conditioned, he or she may continuously be challenged by installing a larger number of more difficult force-resisting elements.

Figure 5A:
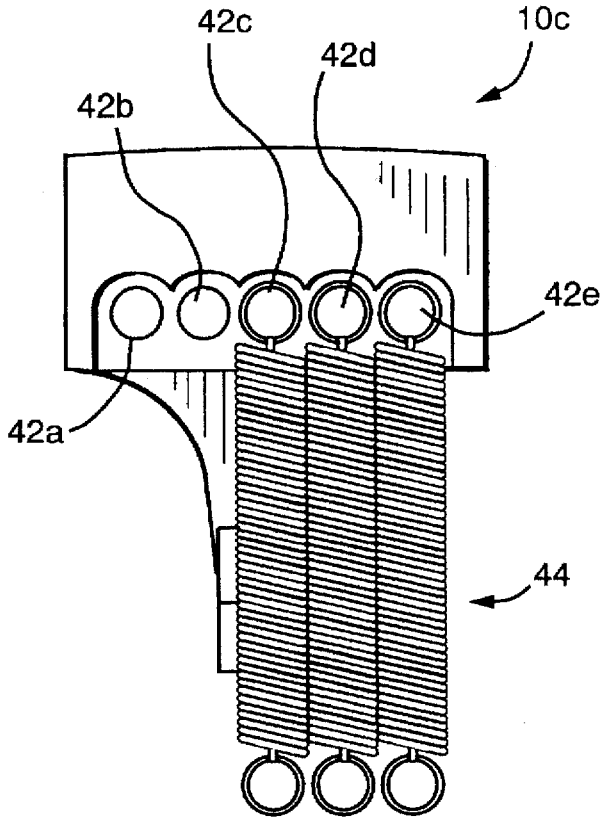
FIG. 5A is a top, plan view of a second preferred embodiment of the heads of the apparatus shown in FIGS. 1A and 1B.
Figure 5B:
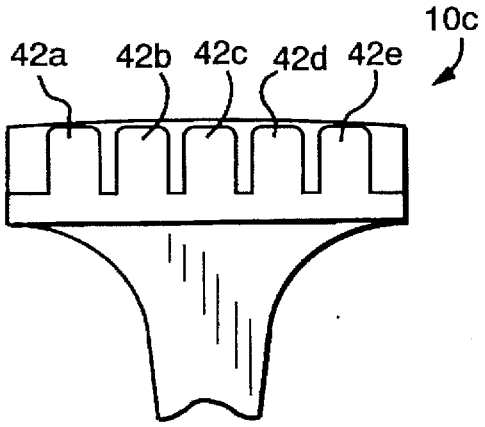
FIG. 5B is a front, elevational view of the head of FIG. 5A.

FIGS. 5A and 5B show a second preferred embodiment for the construction of the heads of members 4*a* and 4*b*. Head 10*c* features five integral, vertically-oriented bosses or posts 42*a*–42*e* to which the ends of three force-resisting elements (springs) 44 are removably attached. Again, it should be understood that any type (or combinations of different types) of force-resisting element may be used so long as the ends of such elements are appropriately shaped and dimensioned to snugly slide onto posts 42*a*–42*e*. If desired, posts 42*a*–42*e* may be sleeved with metal bushings (not shown) to prevent excess wear between the force-resisting elements and the posts. As an added a safeguard, a conventional slide-on cap, spring-type retaining clamp or other device may be placed over the top of each post 42*a*–42*e* to ensure that the force-resisting elements do not slip off the posts.

Figure 6:
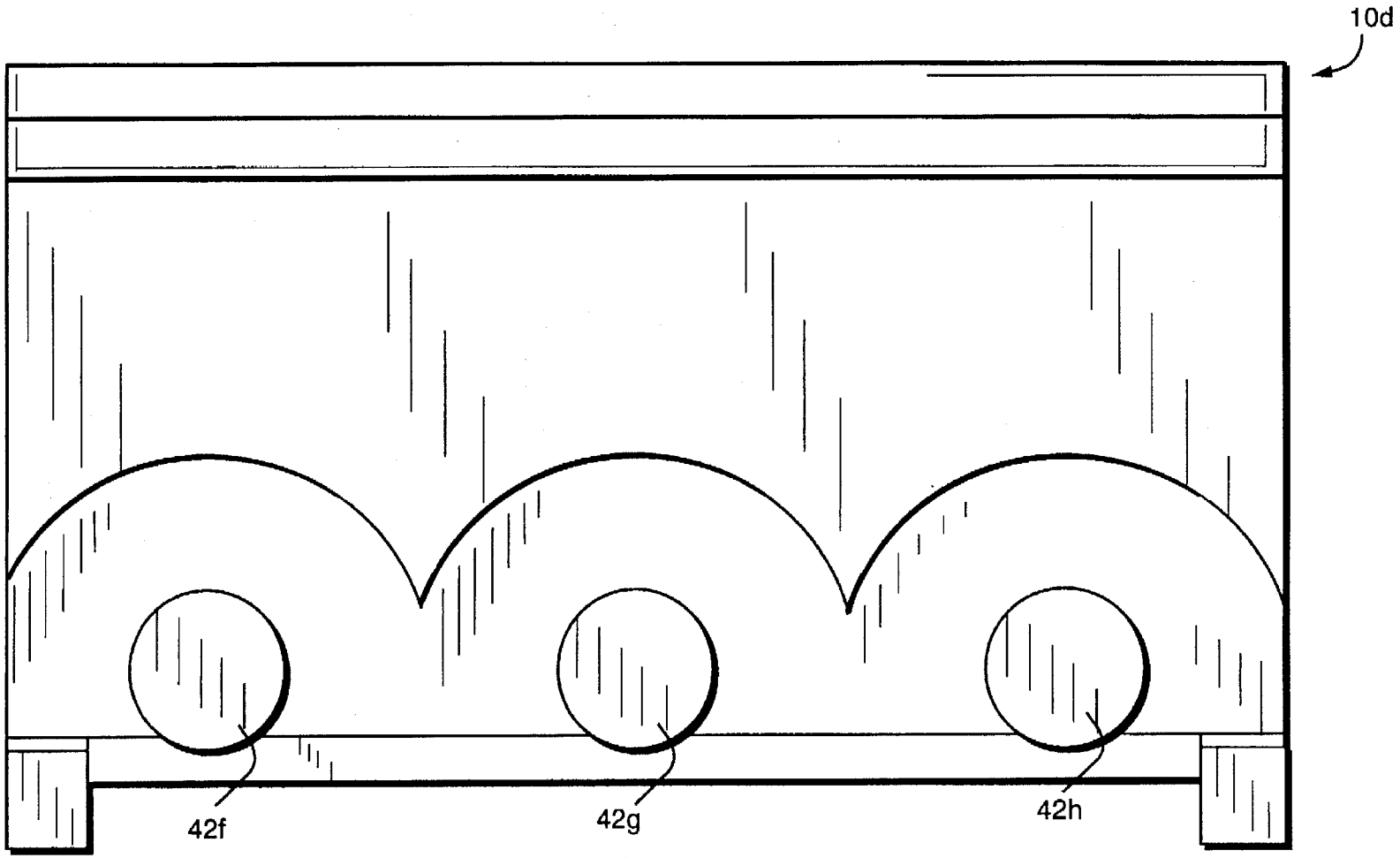
FIG. 6 is a top plan view of a third preferred embodiment of the heads of the apparatus shown in FIGS. 1A and 1B.

FIG. 6 depicts a third preferred embodiment for the construction of the heads of members 4*a* and 4*b*. Head 10*d* is similar to head 10*c* with the exception that only three posts 42*f*–42*h* are provided, as opposed to the five posts of head 10*c*.

Figure 7:
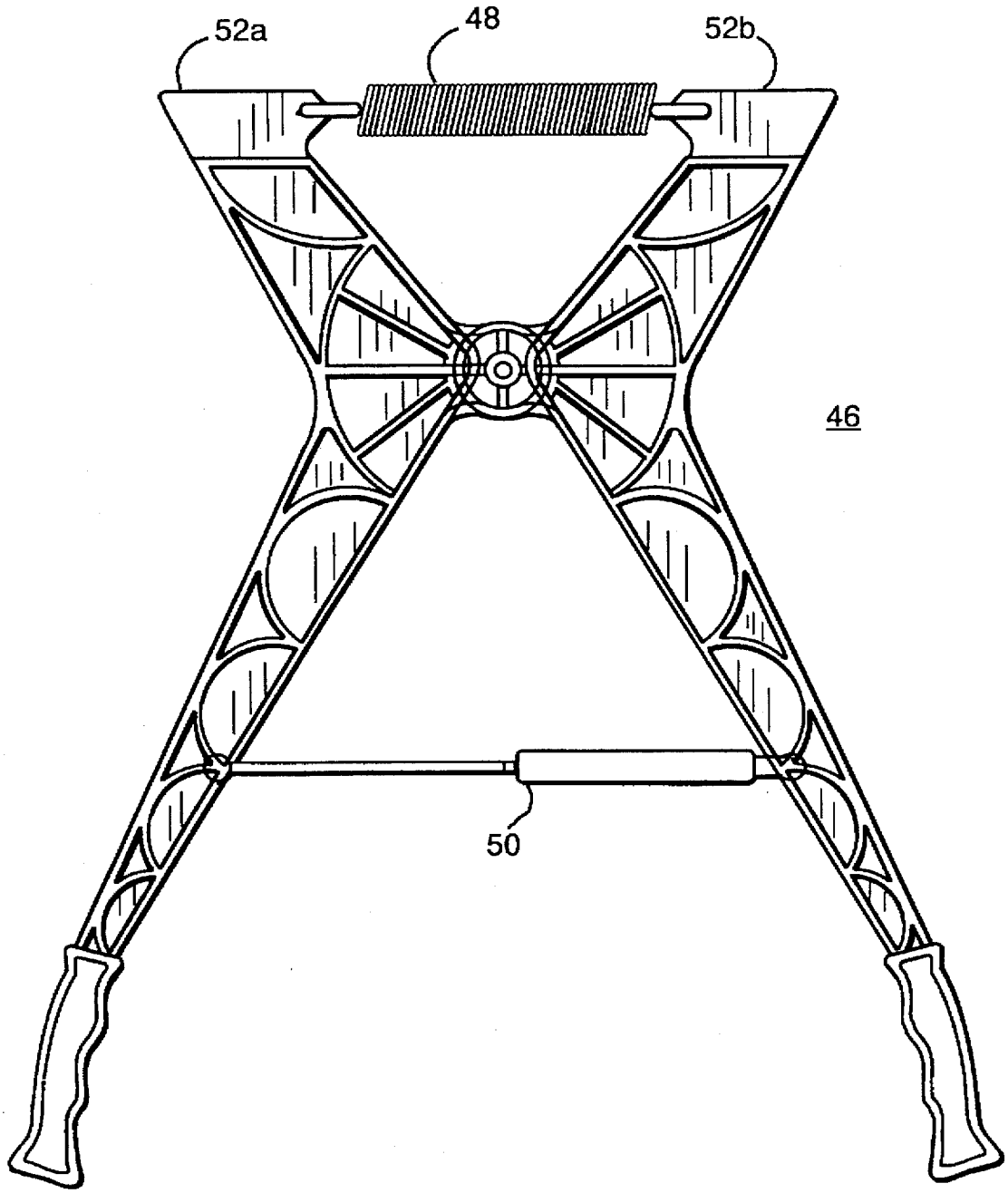
FIG. 7 is a front, elevational view of a second preferred embodiment of the present invention.

FIG. 7 shows a second embodiment of the present invention in which an apparatus 46 includes force-resisting elements 48 secured to its heads 52*a* and 52*b* as well as a dashpot 50 attached to the handles below the central joint. An advantage of this arrangement is that a greater number of force-resisting elements 48 may be attached to heads 52*a* and 52*b* while preserving the safety (anti-backlash) feature of dashpot 50.

Figure 8:
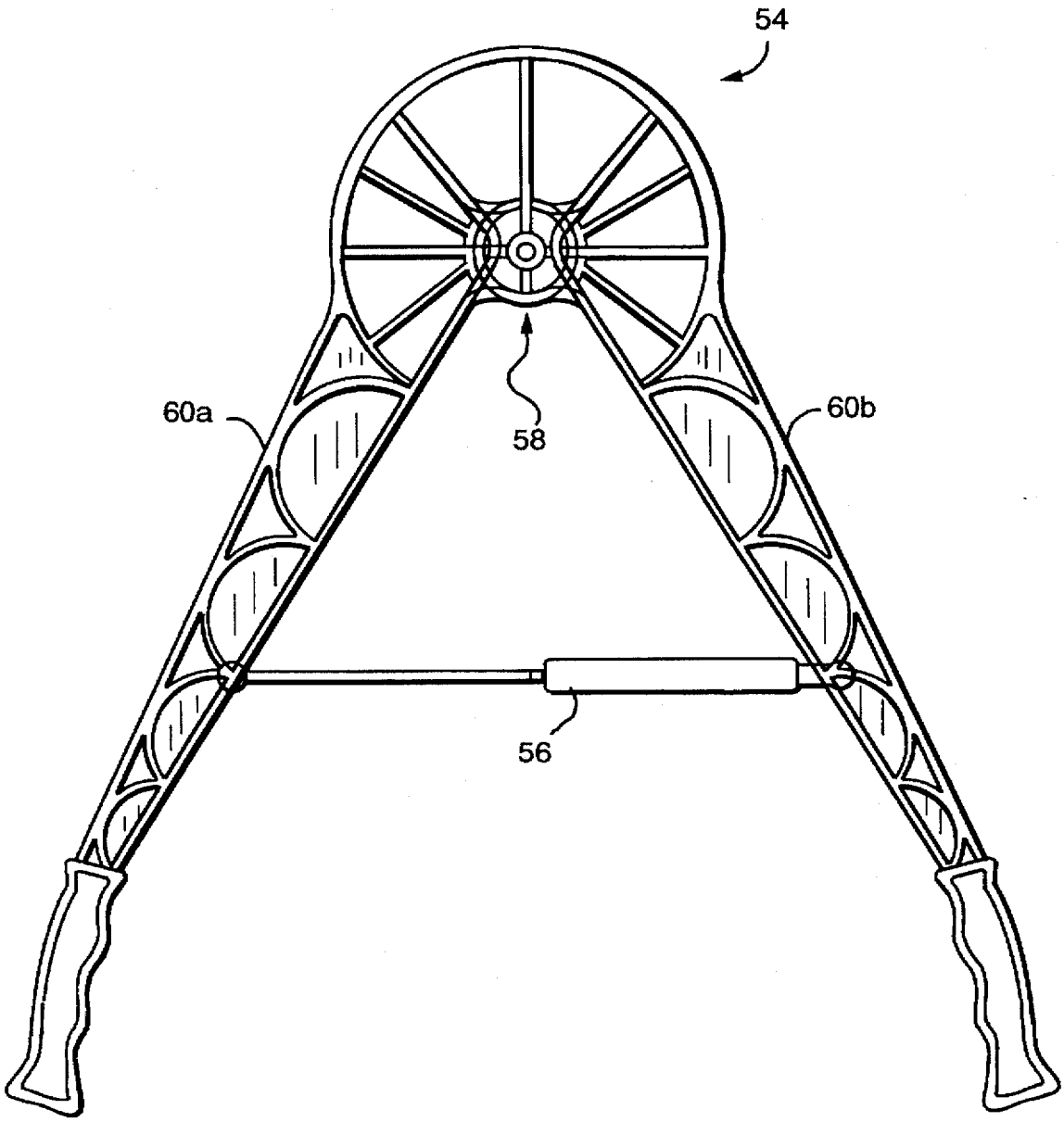
FIG. 8 is a front, elevational view of a third preferred embodiment of the present invention.

FIG. 8 depicts yet another embodiment of the present invention in which the heads are eliminated. In apparatus 54, two members 60*a* and 60*b* are joined at a central joint 58 that is substantially similar to central joint 6 described above. A combined spring/dashpot element 56 is attached to the handles below joint 58. An advantage of this arrangement is that the overall apparatus is more compact and lighter weight.

The foregoing description has been limited to specific embodiments of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. Apparatus for exercising a user's upper body, said apparatus comprising:

first and second members pivotally connected at a central joint, each of said members having a hand grip at one end and a head at the opposite end;

said central joint comprising a pair of overlapping dish each of which is secured to a respective one of said members, a pair of bearing surfaces each of which is located on a respective one of said members and abuts the disk which is secured to the opposite member, and a fastener; and said heads for removably connecting one more force-resisting elements therebetween, said elements being selectable by said user to generate a first resisting force which said user may overcome by urging said hand grips together, or to generate a second resisting force which said user may overcome by urging said hand grips apart, or to generate both said first and second resisting forces.

2. The apparatus as in claim 1 wherein said first and second members are generally V-shaped and said central joint is located at the vertices of said members.

3. The apparatus as in claim 1 wherein said first and second members are constructed from an advanced polymer composite material.

4. The apparatus as in claim 3 wherein said polymer composite comprises a short chopped fiber-reinforced resin.

5. The apparatus as in claim 1 wherein said disks and bearing surfaces are formed as integral parts of said members.

6. The apparatus as in claim 1 wherein each of said heads comprises a plurality of substantially vertical slots defined by a series of walls, each of said walls having a substantially horizontal through hole, and a rod, whereby said force-resisting elements are secured to said heads by inserting said rod through said through holes and corresponding apertures located on said elements.

7. The apparatus as in claim i wherein each of said heads comprises a plurality of substantially vertical posts, whereby said force-resisting elements are secured to said heads by placing apertures located on said elements over respective ones of said posts.

8. The apparatus as in claim 1 wherein at least one of said force-resisting elements comprises an elastomer spring.

9. The apparatus as in claim 1 wherein at least one of said force-resisting elements comprises a combination spring/dashpot.

10. The apparatus as in claim 1 wherein at least one of said force-resisting elements comprises a gas spring.

11. The apparatus as in claim 1 wherein at least one of said force-resisting elements comprises a metal spring.

12. The apparatus as in claim 1 wherein at least one of said force-resisting elements comprises a dashpot.

13. The apparatus as in claim 1 further comprising a dashpot connected to said members between said central joint and said hand grips.

14. Apparatus for exercising a user's upper body, said apparatus comprising:

first and second members pivotally connected by a joint, each of said members having a hand grip;

said joint comprising a pair of overlapping disks each of which is secured to a respective one of said members, a pair of bearing surfaces each of which is located on a respective one of said members and abuts the disk which is secured to the opposite member, and a fastener; and one or more force-resisting elements connected between said first and second members.

15. The apparatus as in claim 14 wherein said first and second members are constructed from an advanced polymer composite material.

16. The apparatus as in claim 15 wherein said polymer composite comprises a short chopped fiber-reinforced resin.

17. The apparatus as in claim 14 wherein said dish and bearing surfaces are formed as integral parts of said members.

18. The apparatus as in claim 14 wherein said first and second members are generally V-shaped having a head at a first end, said hand grip at a second end, and said joint is located at the vertices of said members.

19. The apparatus as in claim 18 wherein each of said heads comprises a plurality of substantially vertical slots defined by a series of walls, each of said walls having a substantially horizontal through hole, and a rod, whereby said force-resisting elements are secured to said heads by inserting said rod through said through holes and corresponding apertures located on said elements.

20. The apparatus as in claim 18 wherein each of said heads comprises a plurality of substantially vertical posts, whereby said force-resisting elements are secured to said heads by placing apertures located on said elements over respective ones of said posts.

21. The apparatus as in claim 18 wherein at least one of said force-resisting elements comprises an elastomer spring.

22. The apparatus as in claim 18 wherein at least one of said force-resisting elements comprises a combination spring/dashpot.

23. The apparatus as in claim 18 wherein at least one of said force-resisting elements comprises a gas spring.

24. The apparatus as in claim 18 wherein at least one of said force-resisting elements comprises a metal spring.

25. The apparatus as in claim 18 wherein at least one of said force-resisting elements comprises a dashpot.

26. The apparatus as in claim 18 further comprising a dashpot connected to said members between said central joint and said hand grips.

* * * * *